US007090204B2

(12) United States Patent
Zwimpfer et al.

(10) Patent No.: US 7,090,204 B2
(45) Date of Patent: Aug. 15, 2006

(54) CARBURETOR ARRANGEMENT

(75) Inventors: Markus Zwimpfer, Fellbach (DE); Reinhard Friedrich, Waiblingen (DE); Florian von Krane, Buoch (DE); Klaus-Martin Uhl, Baltmannsweiler (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/952,756

(22) Filed: Sep. 30, 2004

(65) Prior Publication Data

US 2005/0073062 A1 Apr. 7, 2005

(30) Foreign Application Priority Data

Oct. 1, 2003 (DE) ..... 103 45 653

(51) Int. Cl.
*F02M 23/03* (2006.01)

(52) U.S. Cl. ..... 261/46; 123/73 PP; 261/47; 261/63; 261/DIG. 1

(58) Field of Classification Search ..... 261/23.3, 261/46, 47, 63, DIG. 1; 123/73 PP
See application file for complete search history.

(56) References Cited

U.S. PATENT DOCUMENTS 3,205,879 A * 9/1965 Von Seggern et al. ..... 123/581
4,086,885 A * 5/1978 Noguchi et al. ..... 123/274
6,101,991 A * 8/2000 Glover ..... 123/73 PP
6,328,288 B1 * 12/2001 Gerhardy ..... 261/35
2002/0088412 A1 * 7/2002 Radel et al. ..... 123/73 PP
2003/0106508 A1 6/2003 Rosskamp ..... 123/73 PP

FOREIGN PATENT DOCUMENTS

JP 57-83651 * 5/1982 ..... 261/23.3

* cited by examiner

*Primary Examiner*—Richard L. Chiesa
(74) *Attorney, Agent, or Firm*—Walter Ottesen

(57) ABSTRACT

A carburetor arrangement for a two-stroke engine (1) is for a portable handheld work apparatus such as a motor-driven chain saw, cutoff machine or the like and has an intake channel (22). The intake channel (22) is partitioned by a partition wall (11) into an air channel (8) and a mixture channel (21). A fuel opening (27, 28) for supplying fuel to the two-stroke engine (1) opens into the mixture channel (21). The carburetor arrangement has a carburetor (17) having a carburetor housing (18) wherein an intake channel section (32) is formed. A throttle flap (24) is pivotally journalled in the carburetor housing (18). A good partitioning of the air channel (8) from the mixture channel (21) results with a simple manufacture of the carburetor (17) when a partition wall section (31, 48, 58, 68, 78, 88, 98) is configured as a separate component upstream of the throttle flap (24) and is held in the intake channel (22).

26 Claims, 4 Drawing Sheets

CARBURETOR ARRANGEMENT

CROSS REFERENCE TO RELATED APPLICATION

This application claims priority of German patent application no. 103 45 653.8, filed Oct. 1, 2003, the entire content of which is incorporated herein by reference.

FIELD OF THE INVENTION

The invention relates to a carburetor arrangement and especially a carburetor arrangement for a two-stroke engine in a portable handheld work apparatus such as a motor-driven chain saw, cutoff machine or the like.

BACKGROUND OF THE INVENTION

United States patent publication US 2003/0106508 A1 discloses a carburetor arrangement for a two-stroke engine wherein the intake channel is partitioned by a partition wall into a mixture channel and into an air channel. The partition wall extends downstream as well as upstream of the throttle flap pivotally journalled in the carburetor.

SUMMARY OF THE INVENTION

It is an object of the invention to provide a carburetor arrangement of the kind referred to above which is simply built and can be easily manufactured.

The carburetor arrangement of the invention is for a portable handheld work apparatus having an internal combustion engine. The carburetor arrangement includes: an intake channel; a carburetor having a carburetor housing defining a segment of the intake channel; a partition wall for partitioning the intake channel into an air channel and a mixture channel; a fuel opening formed in the mixture channel for supplying fuel for the engine; a carburetor further having a throttle flap pivotally mounted in the segment of the intake channel; and, a section of a partition wall being configured as a separate component disposed upstream of a throttle flap and held in an intake channel.

With the configuration of the partition wall section as a separate component, this component can be manufactured independently of the carburetor housing. The geometry of the partition wall can be freely selected because the shape is not limited by the direction in which the carburetor is removed from the mold.

A simple attachment of the partition wall in the intake channel can be achieved in that the partition wall section is guided in a slot which runs parallel to the longitudinal axis of the intake channel. The slot can be made in the same production step during the manufacture of the carburetor housing. The partition wall section can be pushed into the intake channel section in the carburetor housing in the direction of the longitudinal axis of the intake channel because the slot is arranged parallel to the longitudinal axis of the intake channel. The partition wall is reliably held by the slot without additional attachment means being needed. It is provided that the slot is delimited by at least one longitudinal strut or strip projecting into the intake channel. The slot base closes flush with the intake channel wall. It can, however, also be practical to configure the slot as a recess in the intake channel wall. In this way, the flow cross section in the intake channel is not affected by the holder of the partition wall section. It can, however, also be advantageous when the slot base is configured to be raised relative to the intake channel wall.

For fixing the partition wall section in the intake channel, the partition wall section has a stop which fixes the position of the partition wall section in the intake channel. Advantageously, the stop lies against the carburetor housing at the end face of the carburetor housing lying upstream. The partition wall can then be inserted into the intake channel from the end face lying upstream. The partition wall can be inserted after the assembly of the throttle flap and the throttle shaft. In this way, the accessibility during assembly of the throttle flap on the throttle flap shaft is improved which is usually attached with a screw. The assembly is thereby simplified.

It can, however, also be practical to configure a shoulder on the slot at the end facing toward the throttle shaft with the stop lying against the shoulder. The partition wall can then be inserted into the intake channel section from the end of the carburetor housing lying downstream and is fixed in the intake channel by the throttle shaft assembled subsequently. The carburetor housing has a support bore from the intake channel to the outside of the housing through which the throttle shaft projects. It can be provided that the slot extends from the end face of the carburetor housing lying upstream to the support bore of the throttle shaft. The slot especially extends over the entire length of the carburetor housing. A slot, which is configured as a recess, can be manufactured in this way in a simple manner. In order to avoid that the support of the throttle shaft is negatively affected by the slot, it is provided that the throttle shaft is supported in a bearing bushing mounted in the support bore and the partition wall lies against the bearing bushing. The bearing bushing thereby simultaneously forms a stop which limits the insertion depth of the partition wall into the intake channel.

The partition wall section is advantageously configured as one piece with a sleeve wherein an intake channel section is configured. The partition wall section is pushed into the carburetor housing together with the sleeve. The shape of the sleeve and of the partition wall are then independent of the shape of the carburetor housing. In order to secure the position of the sleeve in the intake channel, it is provided that the sleeve lies against a shoulder in the carburetor housing. Advantageously, the shoulder has an annular shape so that the sleeve lies against the shoulder over its periphery. An annularly-shaped shoulder can be produced in the intake channel in a simple manner.

In order to obtain a good partition of the air channel from the mixture channel upstream of the throttle flap, it is provided that the partition wall section has an edge against which the throttle flap lies in the open position. The partition wall section advantageously reaches up to the throttle shaft so that, in the open position of the throttle flap, a high covering of the partition wall section by the throttle flap results. In this way, the mixture channel and the air channel are substantially seal-tightly separated from each other. A projection is advantageously arranged on the partition wall and this projection projects into the mixture channel and reduces the flow cross section in the mixture channel. A reduction of the flow cross section functions to match the ratio of the supplied air and the supplied mixture to each other. The projection can be formed in a simple manner on the partition wall.

In order to obtain a good separation of the air channel from the mixture channel, it is provided that the partition wall section extends beyond the carburetor housing on the end face lying upstream. It is practical to configure the partition wall section so as to be bent over relative to the longitudinal axis of the intake channel in a section projecting beyond the end face of the carburetor. Advantageously, the partition wall section is bent over to the mixture channel in a first section. In a second section, the partition wall section is especially bent over toward the air channel. The bending over of the partition wall section toward the air channel leads to the situation that the air channel draws air from a region facing away from the mixture channel. During operation of the engine, the fuel passes through the mixture channel also into a region upstream of the carburetor, especially, into an air filter because of the engine pulsations. There, the fuel forms a fuel fog which can be drawn into the air channel. With the bending over of the partition wall in a direction toward the air channel, the air channel draws the air out from a region facing away from the mixture channel so that the condition can be avoided that the mixture gets into the air channel. It is practical that the slot, in which the partition wall is guided, has a spacing to the rotational axis of the throttle shaft. The throttle shaft is especially offset relative to the slot so that there is no negative effect on the guidance of the throttle shaft by the slot.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
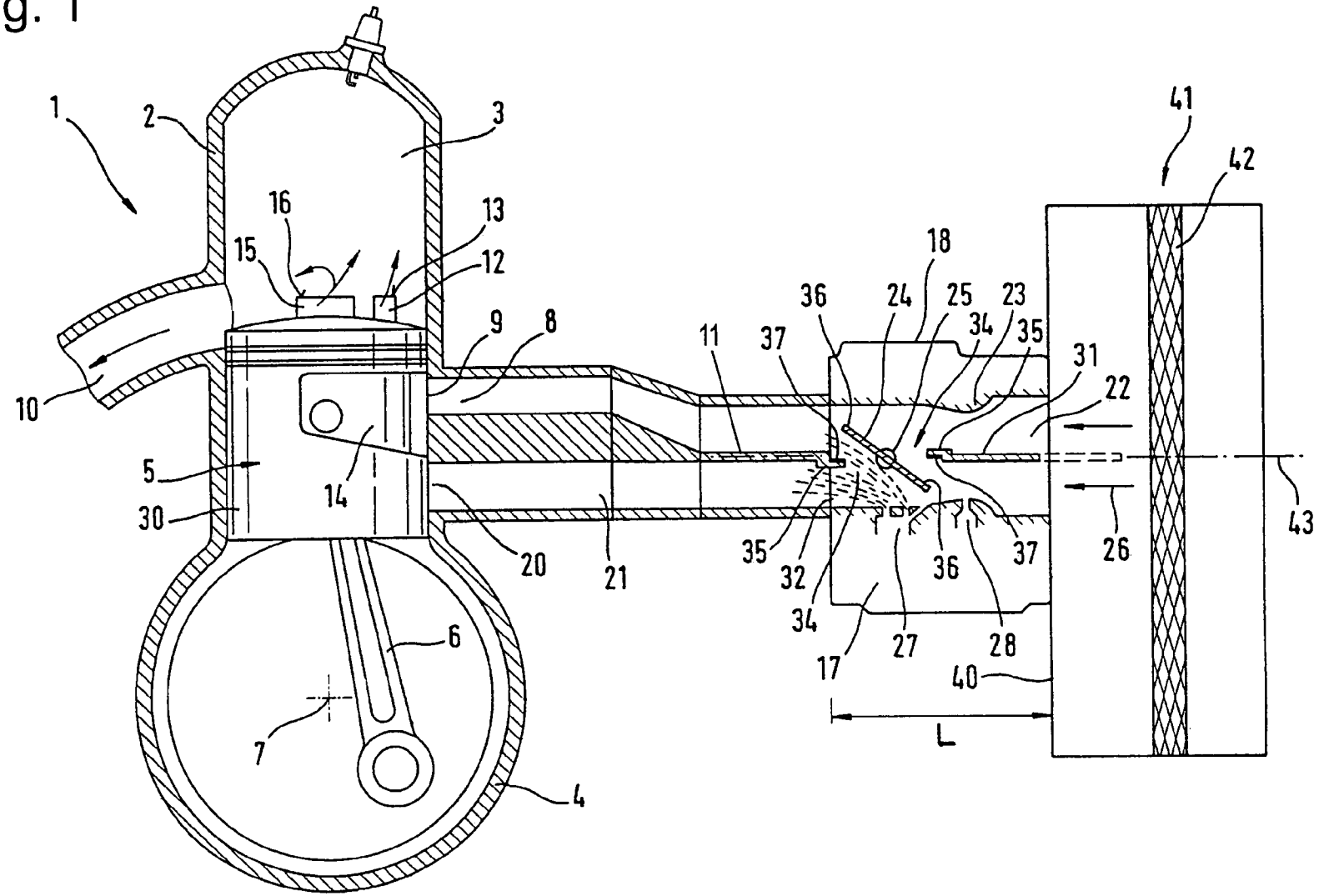
FIG. 1 is a schematic section view through an internal combustion engine having a carburetor arrangement.

The two-stroke engine 1 shown in FIG. 1 has a combustion chamber 3 formed in a cylinder 2. The combustion chamber 3 is delimited by a piston 5. The piston 5 is reciprocally journalled in the cylinder 2 and drives a crankshaft 7 via a connecting rod 6. The crankshaft 7 is journalled in a crankcase 4. A mixture channel 21 having an inlet 20 and an air channel 8 having an air window 9 open at the cylinder 2. The inlet 20 and the air window 9 are slot controlled by the piston jacket 30 of the piston 5. The crankcase 4 is connected via two transfer channels (12, 15) to the combustion chamber 3 in the position of the piston 5 shown in FIG. 1 at bottom dead center. The transfer channels (12, 15) open with transfer windows 13 and 16 into the combustion chamber 3. An air/fuel mixture flows from the crankcase 4 into the combustion chamber 3 via the transfer channels 12 and 15. The piston 5 has a piston pocket 14 which connects the air window 9 with the transfer windows 13 and 16 of the transfer channels 12 and 15 at pregiven positions of the piston 5.

During operation of the two-stroke engine 1, air/fuel mixture flows from the crankcase 4 via the transfer channels 12 and 15 into the combustion chamber 3 in the position of the piston 5 shown in FIG. 1 at bottom dead center. The air/fuel mixture in the combustion chamber 3 is compressed with the upward stroke of the piston 5. During the upward stroke of the piston 5, the air window 9 is connected via the piston pocket 14 to the transfer windows 13 and 16. Substantially fuel-free air flows from the air channel 8 into the transfer channels 12 and 15 and displaces the mixture in the transfer channels in the direction toward the crankcase 4. In the region of top dead center of the piston 5, the air/fuel mixture is ignited in the combustion chamber 3 and this accelerates the piston in the direction toward the crankcase 4. With the downward stroke of the piston 5, the outlet 10 out of the combustion chamber 3 is cleared and the exhaust gases leave the combustion chamber 3 through the outlet 10. As soon as the transfer windows 13 and 16 are cleared by the piston 5, the air, which is prestored in the transfer channels 12 and 15, and, thereafter, the air/fuel mixture flow out of the crankcase 4 into the combustion chamber 3. The air, which is prestored in the transfer channels, effects a separation of the exhaust gases from the air/fuel mixture and prevents that fresh fuel can escape through the outlet 10.

The air channel 8 and the mixture channel 21 are shown in an intake channel 22 which is partitioned by a partition wall 11 into the air channel 8 and the mixture channel 21. A carburetor 17 is provided for forming the air/fuel mixture and an intake channel section 32 is formed in this carburetor. The carburetor 17 has a carburetor housing 18 wherein a throttle flap 24 is pivotally journalled on a throttle shaft 25. In the carburetor, a venturi 23 is configured upstream of the throttle flap 24. Idle nozzles 27 open into the mixture channel 21 and a main fuel nozzle 28 opens into the mixture channel 21 in the region of the venturi 23. A partition wall section 31 is arranged upstream of the throttle flap 24. The partition wall section 31 partitions the air channel 8 from the mixture channel 21 upstream of the throttle flap 24 referred to the flow direction 26. An air filter 41 is mounted upstream of the carburetor 17 and the carburetor 17 is mounted on the base 40 of the air filter. The partition wall section 31 can extend into the air filter 41. The partition wall 11 extends thereby over the entire length L of the carburetor housing 18 measured parallel to the longitudinal axis 43 of the intake channel.

In the open position of the throttle flap 24, the throttle flap lies approximately parallel to the intake channel longitudinal axis 43 in the intake channel 22. An edge 35 is formed on each of the partition wall section 31 and the section of the partition wall 11 facing toward the throttle flap 24. The edges 35 are each provided with a seal 37. The flap edge 36 of the throttle flap 24 lies against the edge 35 so that the throttle flap 24 closes seal-tight with the partition wall 11 and separates the air channel 8 completely from the mixture channel 21.

In the slightly opened position of the throttle flap 24 shown in FIG. 1, connecting openings 34 are formed between the throttle flap 24 and the partition wall 11 upstream as well as downstream of the throttle flap 24. These connecting openings 34 connect the air channel 8 to the mixture channel. In this way, the underpressure in the air channel 8 can be compensated at low load of the two-stroke engine 1. In the air filter 41, a filter element 42 is mounted which separates the uncleaned air side of the air filter 41 connected to the ambient from the clean side connected to the intake channel 22. In order to be able to easily manufacture the carburetor 17, the partition wall section 31 upstream of the throttle flap 24 is configured as a separate component. The partition wall section 31 is inserted into the intake channel 22 in the direction of the longitudinal axis 43 of the intake channel.

Figure 2:
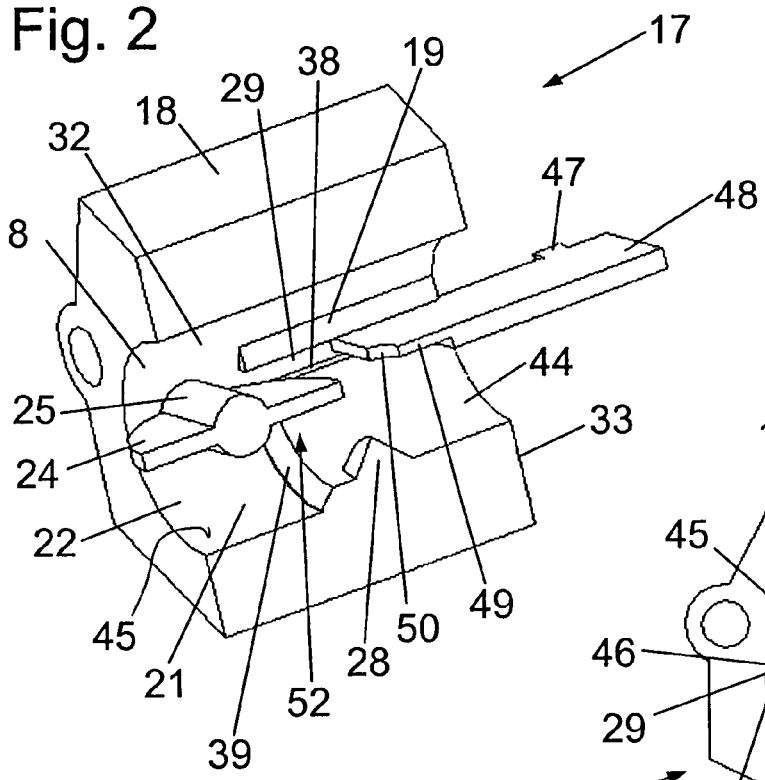
FIG. 2 is a perspective section view of a carburetor with a partially inserted partition wall section.

FIG. 2 shows an embodiment of the carburetor 17 having an inserted partition wall section 48. The intake channel section 32 is formed in the carburetor housing 18 and the throttle flap 24 is pivotally journalled with the throttle shaft 25.

Upstream of the throttle flap 24, the intake channel 22 is partitioned by a partition wall section 48 into an air channel 8 and a mixture channel 21. The partition wall section 48 is configured as a separate component and is guided in a slot 29 in the intake channel 22. The slot 29 extends parallel to the longitudinal axis 43 of the intake channel shown in FIG. 1. The intake channel longitudinal axis 43 runs in the flow direction 26 and connects the geometric center points in each flow cross section. The partition wall section 48 is insertable into the intake channel 22 from the end face 33 of the carburetor 17 lying upstream.

In FIG. 2, the partition wall section 48 is inserted halfway into the slot 29. The partition wall section 48 has a stop 47 which extends laterally of the partition wall section 48 in the plane defined by the partition wall section 48. For a partition wall section 48, which is completely inserted into the intake channel 22, the stop 47 lies against the end face 33 of the carburetor housing 18. A fuel nozzle 28 opens into the mixture channel 21 and this fuel nozzle can be fed from the fuel metering system. The fuel nozzle 28 can also open into the mixture channel 21 downstream of the throttle flap 24. The carburetor 17 can, however, also be configured as a membrane carburetor and a venturi section can be formed in the region of the fuel nozzle 28.

Figure 3:
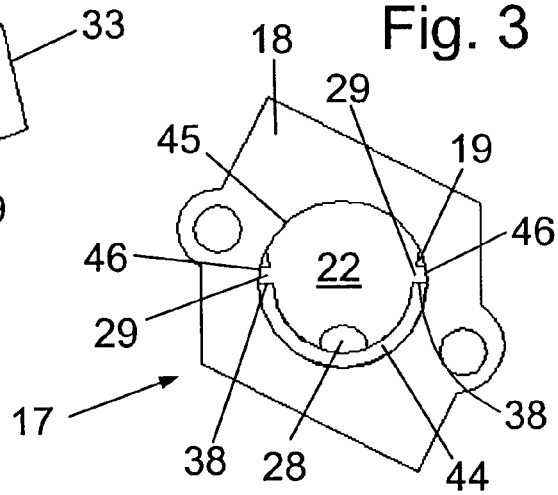
FIG. 3 is an end elevation view of the carburetor of FIG. 2.

As shown also in FIG. 3, the mixture channel wall section 44 upstream of the throttle flap 24 is offset in the intake channel 22 so that the flow cross section in the mixture channel 21 is reduced. The mixture channel wall section 44 forms a shoulder 39 to the channel wall 45 in the region of the throttle flap 24. On the side, which faces toward the air channel 8, the slot 29 is delimited by a longitudinal rail or strip 19. On the side facing toward the mixture channel wall section 44, the partition wall section 48 lies on a shoulder 38 at the mixture channel wall section 44. The mixture channel wall section 44 thereby delimits the slot 29 on the side facing toward the mixture channel 21. The slot base 46 extends evenly into the intake channel wall 45. In the region of the throttle flap 24, the partition wall section 48 has an edge 49 on which the throttle flap 24 lies against in the open position 52 shown in FIG. 2 with the partition wall section 48 being fully inserted. A half-circularly-shaped cutout 50 is provided at the edge 49 in the region of which an attachment screw (not shown) is arranged. The throttle flap 24 is fixed to the throttle shaft 25 with this attachment screw.

Figure 4:
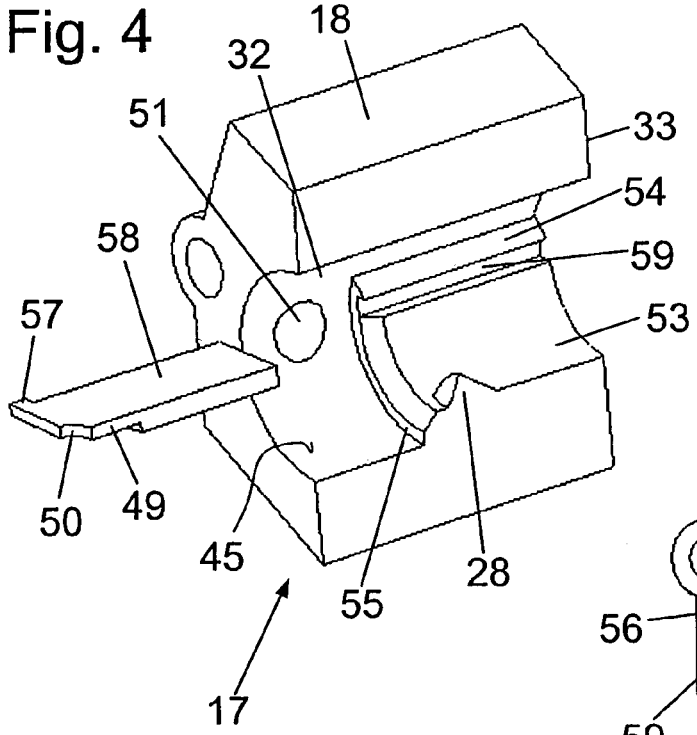
FIG. 4 is an exploded perspective section view of a carburetor and a partition wall section.
Figure 5:
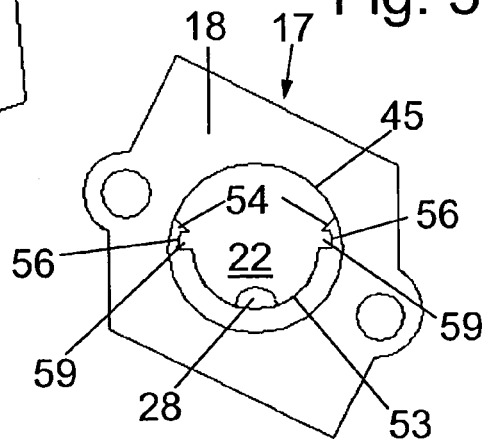
FIG. 5 is an end elevation view of the carburetor of FIG. 4.

FIG. 4 shows a further embodiment of the carburetor 17. A slot 59 is formed in the intake channel section 32 formed in the carburetor housing 18. The slot 59 runs parallel to the longitudinal axis 43 of the intake channel shown in FIG. 1. As also shown in FIG. 5, the slot base 56 is configured raised relative to the intake channel wall 45 and projects into the intake channel 22. A partition wall section 58 is provided which can be inserted into the slot 59 from the end facing toward the throttle shaft 25. At the end, which faces toward the throttle shaft 25, the partition wall section 58 has a stop 57. When the partition wall section 58 is completely inserted into the slot 59, the stop 57 lies against a shoulder 55 which is formed between a mixture channel wall section 53 and the intake channel wall 45. The mixture channel wall section 53 is the wall section delimiting the mixture channel 21 upstream of the throttle shaft 25 and is, as shown in FIG. 5, displaced in the intake channel 22 and effects a reduction of the flow cross section in the mixture channel 21. The two mutually adjacently arranged slots 59 are delimited by longitudinal rails or strips 54 at the side facing toward the air channel 8 and by the mixture channel wall sections 53 at the opposite-lying side facing toward the mixture channel 21. As shown in FIG. 4, the carburetor housing 18 has a bearing bore 51 wherein the throttle shaft 25 is journalled after the complete insertion of the partition wall section 58 into the slots 59. The throttle shaft 25 then fixes the partition wall section 58 in the intake channel 22. The partition wall section 58 has an edge 49 at the end facing toward the throttle flap 24 as well as a cutout 50 for an attachment screw of the throttle flap 24. The throttle flap 24 lies against the edge 49 in the open position.

Figure 6:
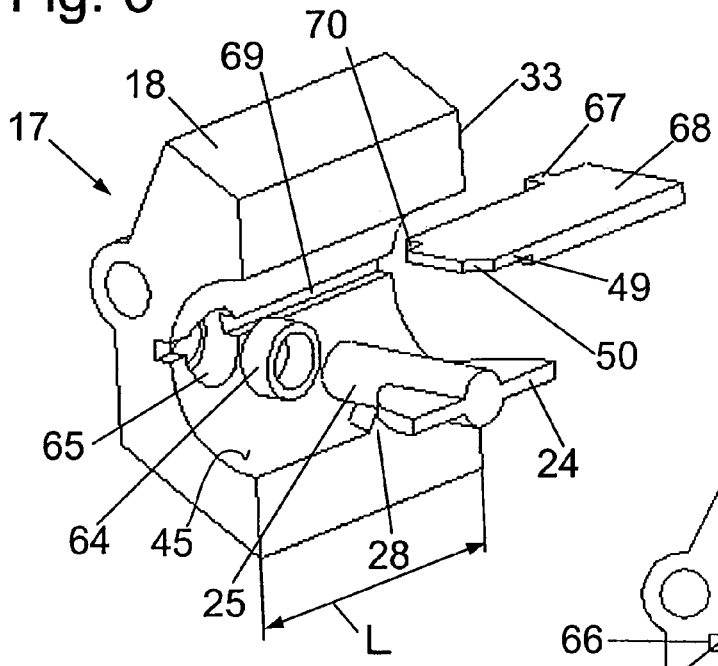
FIG. 6 is an exploded perspective section view of a carburetor according to another embodiment of the invention.
Figure 7:
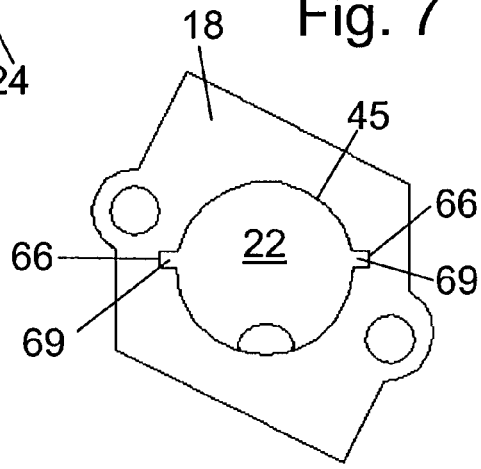
FIG. 7 is an end elevation view of the carburetor of FIG. 6.

FIGS. 6 and 7 show a further embodiment of a carburetor 17. The carburetor housing 18 of the carburetor 17 has mutually adjacent or opposite-lying slots 69 which are configured as recesses in the intake channel wall 45 and extend over the entire length L of the carburetor housing 18. The slots 69 intersect the bearing bore 65 for the throttle shaft 25. A bearing bushing 64 is mounted in the bearing bore 65 and the throttle shaft 25 is journalled in the bearing bushing. The bearing bushing 64 thereby closes the slot 69 at the end facing toward the throttle shaft 25. A partition wall section 68 is provided to partition the air channel 8 and the mixture channel 21 upstream of the throttle shaft 25. At the end facing toward the throttle shaft 25, the partition wall section 68 has a recess 70 in which the bearing bushing 64 is mounted. The bearing bushing 64 and the recess 70 form a stop for the partition wall section 68. However, also or in addition, the stop 67 shown in FIG. 6 can be provided which extends radially outwardly to the longitudinal axis 43 from the partition wall section 68 and lies against the end face 33 of the carburetor housing 18. The partition wall section 68 also has an edge 49 with a cutout 50. In the open position 52, the throttle flap 24 lies against the edge 49. As shown in FIG. 7, the slot base 66 is configured as a recess in the intake channel wall 45 and is displaced radially outwardly to the intake channel longitudinal axis 43 relative to the intake channel wall 45.

Figure 8:
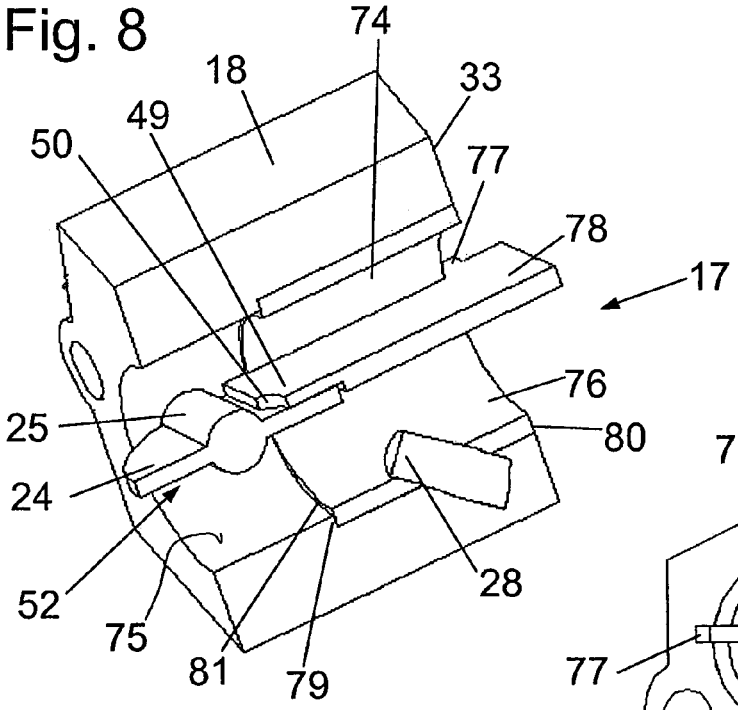
FIG. 8 is a perspective section view of a carburetor according to another embodiment of the invention.
Figure 9:
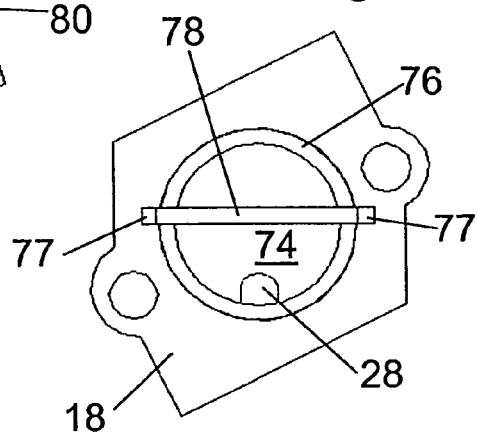
FIG. 9 is an end elevation view of the carburetor of FIG. 8.
Figure 10:
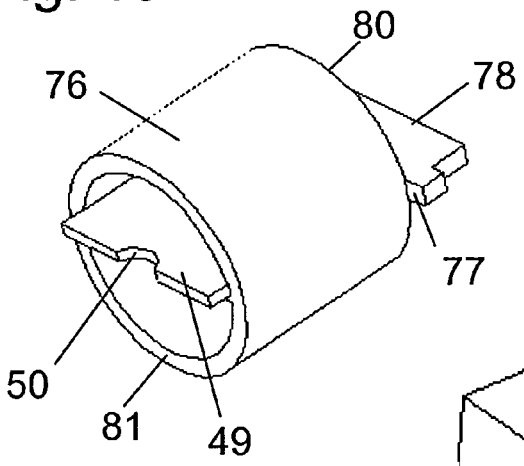
FIG. 10 is a perspective view of a sleeve with the partition wall of FIG. 9.

FIGS. 8 to 10 show a further embodiment of a carburetor 17. A sleeve 76 is mounted in the carburetor housing 18 upstream of the throttle flap 24. An intake channel section 74 is formed in the sleeve 76. The inner diameter of the sleeve 76 is less than the inner diameter of the intake channel 22. A shoulder 79 is formed between the intake channel wall 75, which is configured in the carburetor housing 18, and the section which is formed upstream of the throttle flap 24. The sleeve 76 lies against the shoulder 79 over its entire periphery with its end face 81 lying downstream. The sleeve 76 has a partition wall section 78 which is configured as one piece with the sleeve 76. The partition wall section 78 has a stop 77 which lies against the end face 33 of the carburetor housing 18 and limits the insertion depth of the sleeve 76 into the carburetor housing 18. The end face 80 of the sleeve 76, which lies upstream, closes flush with the end face 33 of the carburetor housing 18. The fuel nozzle 28 projects from the carburetor housing 18 through the sleeve 76. The partition wall section 78 has an edge 49 with a cutout 50 at the end facing toward the throttle flap 24. The throttle flap 24 lies against the edge 49 in the open position 52 shown in FIG. 8.

As shown in FIG. 9, the partition wall section 78 has two stops 77 which lie diametrically opposite each other. In FIG. 10, the partition wall section 78 is shown with the sleeve 76 in perspective. The partition wall section 78 projects at both end faces (80, 81) beyond the sleeve 76.

Figure 11:
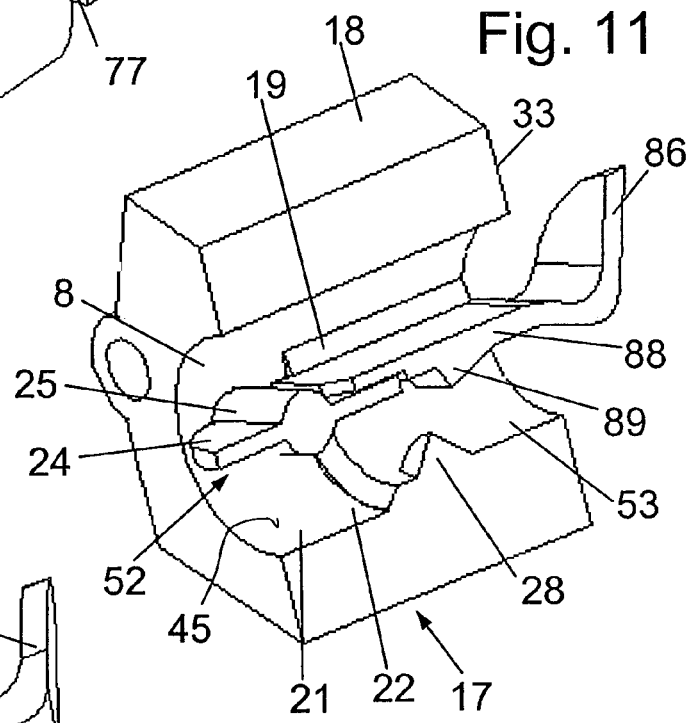
FIG. 11 is a perspective section view of a carburetor according to another embodiment of the invention.
Figure 12:
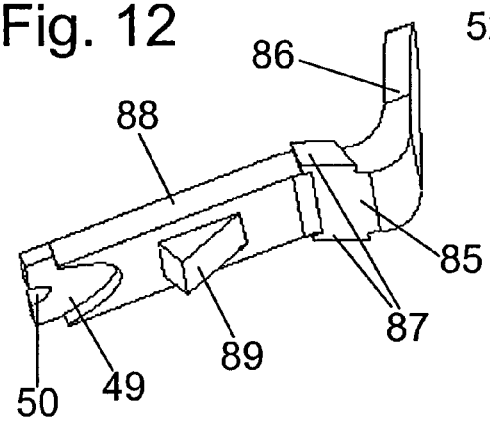
FIG. 12 is a perspective view of the partition wall of the carburetor of FIG. 11.
Figure 13:
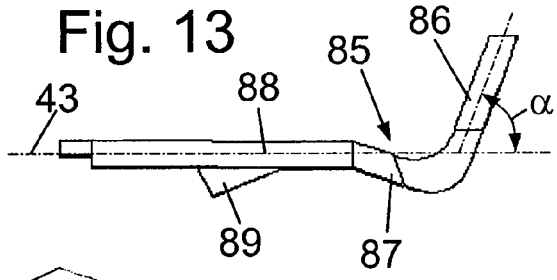
FIG. 13 is a side elevation view of the partition wall of FIG. 12.

In FIG. 11, a further embodiment for a carburetor 17 is shown. In the carburetor housing 18, a partition wall section 88 is pushed into the intake channel 22 from the end face 33 lying upstream. The partition wall section 88 is guided on its longitudinal ends in two slots running in the longitudinal direction of the intake channel 22. The slots are bounded by longitudinal rails or strips 19. The mixture channel wall section 53 upstream of the throttle flap 24 is offset into the intake channel 22 relative to the intake channel wall 45 so that a reduced flow cross section results in the mixture channel 21 upstream of the throttle flap 24. In addition, a projection 89 is formed on the partition wall section 88 and this projection extends into the mixture channel 21 and additionally reduces the flow cross section in the mixture channel 21 at the elevation of the fuel nozzle 28. The partition wall section 88 is extended beyond the end face 33 into an air filter 41 (FIG. 1) mounted upstream of the carburetor 17. As shown especially in FIGS. 12 and 13, the partition wall section 88 has a first bent-over section 85 which is bent over relative to the intake channel longitudinal axis 43 in the direction toward the mixture channel 21. A second bent-over section 86 extends from the first bent-over section 85. The second bent-over section 86 is bent over toward the air channel 8. The second bent-over section 86 and the intake channel longitudinal axis 43 conjointly define an angle $\alpha$ which is especially greater than 45° and advantageously is more than 60°. In this way, it is ensured that air is drawn into the air channel 8 from a region of the air filter 41 wherein no fuel is present from the mixture channel 21. In the region of the first bent-over section 85, two laterally projecting stops 87 are formed on the partition wall section 88 and these stops 87 lie against the end face 33 of the carburetor housing 18 when the partition wall section 88 is inserted into the air channel 22.

Figure 14:
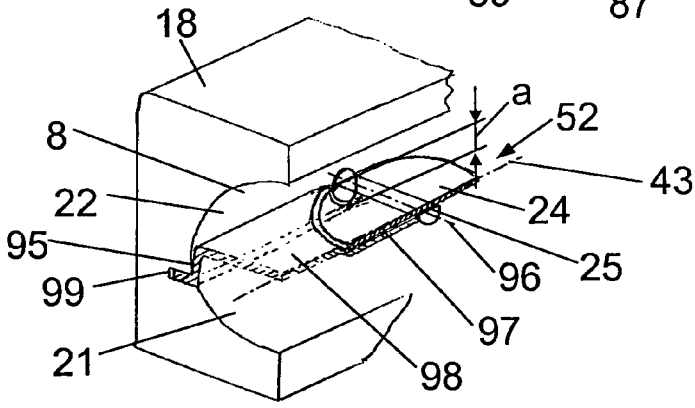
FIG. 14 is a perspective section view of a carburetor according to another embodiment of the invention.

In FIG. 14, a partition wall section 98 is shown pushed into the intake channel 22. The partition wall section 98 is guided in a slot 99 and partitions the intake channel 22 into an air channel 8 and a mixture channel 21. The slot 99 of the partition wall section 98 has a distance (a) to the rotational axis 96 of the throttle shaft 25. The distance (a) is so selected that the slot 99 does not intersect the bearing bore of the throttle shaft 25 so that no negative effect on the bearing or support of the throttle shaft 25 results because of the slot 99. The partition wall section 98 is configured to be bent over in the direction of the intake channel longitudinal axis 43 and has a wall section 95 which extends on the intake channel wall. The partition wall section 98 has an edge 97 at the end facing toward the throttle flap 24. The throttle flap 24 lies against the edge 97 in the open position 52 shown in FIG. 14.

Because of the insertable configuration of the partition wall section, the geometry of the partition wall section can be selected independently of the direction in which the carburetor housing 18 is removed from the mold without negatively affecting the manufacture of the carburetor 17.

It is understood that the foregoing description is that of the preferred embodiments of the invention and that various changes and modifications may be made thereto without departing from the spirit and scope of the invention as defined in the appended claims.

What is claimed is:

1. A carburetor arrangement in a portable handheld work apparatus having an internal combustion engine, the carburetor arrangement comprising:

an intake channel;

a carburetor having a carburetor housing defining a segment of said intake channel;

a partition wall for partitioning said intake channel into an air channel and a mixture channel;

a fuel opening formed in said mixture channel for supplying fuel for said engine;

said carburetor further having a throttle flap pivotally mounted in said segment of said intake channel; and, a section of said partition wall being configured as a separate component disposed upstream of said throttle flap and held in said intake channel.

2. The carburetor arrangement of claim 1, wherein said intake channel has a slot formed therein and said section is guided in said slot.

3. The carburetor arrangement of claim 2, wherein said slot is bounded by at least one longitudinal strip projecting into said intake channel.

4. The carburetor arrangement of claim 3, wherein said intake channel has a wall defining a wall surface; and, said slot has a base which is flush with said wall surface.

5. The carburetor arrangement of claim 3, wherein said intake channel has a wall and said slot is formed as a recess in said wall.

6. The carburetor arrangement of claim 3, wherein said intake channel has a wall defining a wall surface delimiting said intake channel and said slot has a base raised relative to said wall surface.

7. The carburetor arrangement of claim 2, wherein said partition wall section has a stop for fixing the position of said partition wall section in said intake channel.

8. The carburetor arrangement of claim 7, wherein said carburetor housing has an end face disposed upstream of said throttle flap; and, said stop lies in contact engagement with said end face.

9. The carburetor arrangement of claim 7, wherein said slot has an end facing toward said throttle flap; and, said slot has a step formed thereon at said end; and, said stop lies in contact engagement with said step.

10. The carburetor arrangement of claim 2, wherein said throttle flap includes a throttle shaft; and, said carburetor further includes a bearing bore through which said throttle shaft projects.

11. The carburetor arrangement of claim 10, wherein said carburetor housing has an end face lying upstream of said throttle flap; and, said slot extends from said end face to said bearing bore.

12. The carburetor arrangement of claim 11, wherein said slot extends over the entire length (L) of said carburetor housing.

13. The carburetor arrangement of claim 11, wherein said carburetor further includes a bearing bushing disposed in said bearing bore; said throttle shaft is journalled in said bearing bushing; and, said partition wall section lies against said bearing bushing.

14. The carburetor arrangement of claim 1, further comprising a sleeve defining a segment of said intake channel and said partition wall section being formed as one piece with said sleeve.

15. The carburetor arrangement of claim 14, wherein said carburetor housing has a step formed in a segment of said intake channel; and, said sleeve lies in contact engagement with said step.

16. The carburetor arrangement of claim 15, wherein said step has a circular-ring shape.

17. The carburetor arrangement of claim 1, wherein said throttle flap is movable between a first position and a second position wherein said throttle flap is open; and, said partition wall section has an edge on which said throttle flap contact engages when in said second position.

18. The carburetor arrangement of claim 17, wherein said throttle flap includes a throttle shaft and said partition wall section reaches up to said throttle shaft.

19. The carburetor arrangement of claim 1, wherein said partition wall section has a projection formed thereon which projects into said mixture channel so as to reduce the flow cross section thereof.

20. The carburetor arrangement of claim 1, wherein said carburetor housing has an end face upstream of said throttle flap; and, said partition wall section extends beyond said end face upstream of said throttle flap.

21. The carburetor arrangement of claim 20, wherein said intake channel defines a longitudinal axis; and, said partition wall section is bent over with respect to said longitudinal axis in a portion of said partition wall section which is upstream of said end face of said carburetor housing.

22. The carburetor arrangement of claim 21, wherein said portion of said partition wall section is bent over toward said mixture channel.

23. The carburetor arrangement of claim 21, wherein said portion of said partition wall section is bent over toward said air channel.

24. The carburetor arrangement of claim 21, wherein said portion is a first portion which is bent over toward said mixture channel and said partition wall section is bent over in a second portion thereof toward said air channel.

25. The carburetor arrangement of claim 2, wherein said throttle flap includes a throttle shaft defining a rotational axis; and, said slot is at a distance (a) from said throttle shaft.

26. The carburetor arrangement of claim 24, wherein said internal combustion engine is a two-stroke engine.

* * * * *